US010400403B2

(12) United States Patent
Mackenzie

(10) Patent No.: US 10,400,403 B2
(45) Date of Patent: Sep. 3, 2019

(54) DEFLECTOR FOR A SNOW BLOWER

(71) Applicant: Jim Mackenzie, Richmond (CA)

(72) Inventor: Jim Mackenzie, Richmond (CA)

(73) Assignee: LES MACHINERIES PRONOVOST INC., Quebec (CA)

( * ) Notice: Subject to any disclaimer, the term of this patent is extended or adjusted under 35 U.S.C. 154(b) by 210 days.

(21) Appl. No.: 15/653,858

(22) Filed: Jul. 19, 2017

(65) Prior Publication Data

US 2019/0024335 A1 Jan. 24, 2019

(51) Int. Cl.
*E01H 5/04* (2006.01)
*E01H 5/09* (2006.01)

(52) U.S. Cl.
CPC ..... *E01H 5/045* (2013.01); *E01H 5/098* (2013.01)

(58) Field of Classification Search
CPC ..... E01H 5/045; E01H 5/098; E01H 5/04; E01H 5/065
See application file for complete search history.

(56) References Cited

U.S. PATENT DOCUMENTS

| | | | | |
|---|---|---|---|---|
| 2,735,199 | A * | 2/1956 | Wanner et al. | E01H 5/04 198/657 |
| 3,552,045 | A * | 1/1971 | Fieber | E01H 5/045 285/185 |
| 5,127,174 | A * | 7/1992 | Takeshita | E01H 5/04 37/250 |
| 2013/0291412 | A1* | 11/2013 | Cmich | E01H 5/098 37/251 |
| 2016/0362859 | A1* | 12/2016 | Schaedler | E01H 5/098 |
| 2017/0152638 | A1* | 6/2017 | Fu | E01H 5/098 |

FOREIGN PATENT DOCUMENTS

| | | | | |
|---|---|---|---|---|
| CA | 2239744 | A1 | 12/1999 | |
| CA | 2351755 | A1 | 6/2001 | |
| CA | 2708236 | A1 * | 1/2012 | E01H 5/045 |
| CA | 2883871 | A1 | 5/2015 | |
| CA | 2844483 | A1 | 6/2015 | |
| CA | 2883871 | A1 * | 9/2015 | E01H 5/045 |
| CA | 2918227 | A1 * | 3/2017 | E01H 5/098 |

OTHER PUBLICATIONS

Canadian Intellectual Property Office: Canadian Patent Application No. 2,973,528 filed Jul. 14, 2017 entitled "Deflector for a Snow Blower".

* cited by examiner

*Primary Examiner* — Jamie L McGowan
(74) *Attorney, Agent, or Firm* — Middleton Reutlinger

(57) ABSTRACT

A snow deflector for a snow blower is formed from a plate member. The plate member includes a first surface portion for being disposed covering a portion of a snow-receiving opening of a fan housing of the snow blower, and a second surface portion configured to cooperate with an adjacent rear interior surface of the snow blower to guide snow along a direction laterally toward a predetermined target region of the snow-receiving opening that is after a discharge chute opening in the fan housing along a direction of fan rotation. The snow is guided simultaneously vertically upward and longitudinally frontward. The first and second surface portions are disposed within respective first and second planes that intersect one another along a common edge shared between the first and second surface portions. The common edge being aligned generally toward the predetermined target region when the plate member is in the installed condition.

21 Claims, 9 Drawing Sheets

DEFLECTOR FOR A SNOW BLOWER

FIELD OF THE INVENTION

The invention relates generally to the field of snow clearing apparatus and methods. More particularly, the invention relates to a deflector for a snow blower, such as for instance a vehicle mounted pull-type snow blower.

BACKGROUND OF THE INVENTION

Snow blower implements for being mounted to a vehicle, such as for instance a tractor, are well known. One common type of snow blower is configured to be mounted at the front of the vehicle, for clearing a path of snow in front of the vehicle as the vehicle drives in a forward direction. A second common type of snow blower is configured to be mounted at the rear of the vehicle, for clearing a path of snow behind the vehicle as the vehicle drives in a forward direction. The second type of snow blower is commonly referred to as a pull-type snow blower or an inverted snow blower.

Typical pull-type snow blowers may include an auger that is mounted in a horizontal orientation within a box, which forms part of the snow blower frame. As the snow blower moves forward, snow accumulates within the box and comes into contact with the auger. The auger extends laterally within the box, such that as the auger rotates the snow is transported toward a central portion of the box. Lift pallets are mounted on the auger axle for scooping the snow from this central portion of the box and feeding it into a fan, which in turn propels the snow upward through a discharge chute opening and in to a discharge chute. The discharge chute may be adjusted during use so as to direct the snow into a discharge area adjacent to the surface that is being cleared of snow.

The rotating fan is disposed within a housing and receives the snow from the lift pallets via a snow-receiving opening, which may be circular in shape. A problem that is encountered with some prior art snow blowers is that some of the snow may be introduced into the fan at a point that is only shortly ahead of the discharge chute opening, along the direction of fan rotation. Snow that is introduced close to, and in front of, the discharge chute opening, along the direction of fan rotation, is not compacted significantly prior to being propelled out through the discharge chute opening. This loosely compacted snow interferes with the transport of snow that is introduced into other regions of the fan, slowing the flow of snow out through the discharge chute. In addition, snow that is introduced into the center of the fan mixes with the air flow from the fan, thereby producing a light snow-mist that does not travel very far. The cumulative effect is that snow exits from the discharge chute as a loose cloud that is difficult to direct, and which may become scattered or sprayed over a relatively wide area and/or may be blown back onto the cleared surface due to gusting winds. The snow blower operator may also have difficulty throwing the loosely packed snow far enough to avoid obstacles such as cars, sidewalks etc., without depositing a layer of snow on top of said obstacles.

A prior art solution to this problem is to install a so-called blocker plate over a portion of the snow-receiving opening, which prevents the introduction of snow into the fan shortly ahead of the discharge chute opening and optionally other locations that interfere with the transport of snow within the fan housing. Unfortunately, the blocker plate merely serves as a physical barrier and any snow colliding therewith simply falls back to the ground under the influence of gravity. The prior art solution therefore suffers from at least three significant drawbacks. Firstly, the snow that falls back to the ground must be lifted again using the lift pallets. Some of this "recycled" snow may enter the fan and some may collide once again with the blocker plate. "Recycling" the snow before it is finally discharged is wasteful of fuel and time. Secondly, when the snow blower is lifted out of contact with the ground surface that is being cleared of snow at the end of each pass, the last of the snow that was blocked by the blocker plate remains on the ground surface and is not recycled to the fan. If the piles of snow are left on a public roadway, they may pose a safety hazard and/or result in the snow blower operator being fined. Alternatively, the snow blower operator must make at least one final pass in order to clear the piles that have been deposited, which also is wasteful of fuel and time. Thirdly, the blocker plate does not enhance the compaction of the snow prior to the snow being discharged via the discharge chute, and therefore does not alleviate the problems of: controlling the direction of snow-discharge to avoid coating obstacles with snow; preventing the formation of a snow-mist that may reaccumulate on the just-cleared surface; and increasing the distance the snow can be thrown, etc.

It would be beneficial to provide a snow clearing apparatus and method that overcomes at least some of the above-mentioned disadvantages and drawbacks that are associated with the prior art solutions.

SUMMARY OF THE INVENTION

According to an aspect of at least one embodiment, there is provided a snow deflector for a snow blower, comprising: a plate member having a first surface portion configured for being disposed covering a portion of a snow-receiving opening of a fan housing of the snow blower when the plate member is in an installed condition, and having a second surface portion configured to cooperate with an adjacent rear interior surface of the snow blower to guide snow, which is lifted toward the plate member using lift pallets mounted on an auger axle, along a direction that is laterally toward a predetermined target region of the snow-receiving opening of the fan housing and that is after a discharge chute opening in the fan housing along a direction of rotation of a fan that is disposed within the fan housing, and for simultaneously guiding the snow vertically upward and longitudinally frontward toward the predetermined target region of the snow-receiving opening, wherein the first and second surface portions of the plate member are disposed within respective first and second planes that intersect one another along a common edge that is shared between the first and second surface portions, and wherein said common edge is aligned generally toward the predetermined target region of the snow-receiving opening of the fan housing when the plate member is in the installed condition.

According to an aspect of at least one embodiment, there is provided a snow blower for being mounted to a vehicle and for being powered by a power take off (PTO) shaft of said vehicle, comprising: a box for containing snow to be removed from a ground surface, the box having an inner first surface that is inclined to the horizontal along a first direction; a fan housing disposed longitudinally frontward of the inner first surface along a snow clearing direction, the fan housing having a snow-receiving opening facing the inner first surface of the box and having a discharge chute opening; a fan disposed within the fan housing and comprising a plurality of radially extending blades that is rotationally mounted within the fan housing, the fan being in operative communication with the PTO shaft of the vehicle; an auger disposed within the box and between the inner first surface of the box and the fan housing along the longitudinal direction, the auger comprising a plurality of lift pallets disposed approximately at the center thereof, and the auger being in operative communication with the PTO shaft of the vehicle; and a snow deflector, comprising: a plate member having a first surface portion disposed parallel to the snow-receiving opening of the fan housing of the snow blower, and having a second surface portion fixedly secured to the inner first surface of the box and being configured to cooperate with said interior first surface of the box to guide snow, which is lifted toward the plate member using the lift pallets mounted on the auger, along a direction that is laterally toward a predetermined target region of the snow-receiving opening of the fan housing and that is after the discharge chute opening in the fan housing along a direction of rotation of the fan, and for simultaneously guiding the snow vertically upward and longitudinally frontward toward the predetermined target region of the snow-receiving opening, wherein the first and second surface portions of the plate member are disposed within respective first and second planes that intersect one another along a common edge shared between the first and second surface portions, and wherein said common edge is aligned generally toward the predetermined target region of the snow-receiving opening of the fan housing.

According to an aspect of at least one embodiment, there is provided a snow blower for being mounted to a vehicle and for being powered by a power take off (PTO) shaft of said vehicle, comprising: a box for containing snow to be removed from a ground surface, the box having an inner first surface that is inclined to the horizontal along a first direction; a fan housing disposed longitudinally frontward of the inner first surface along a snow clearing direction, the fan housing having a snow-receiving opening facing the inner first surface of the box; a fan disposed within the fan housing and comprising a plurality of radially extending blades that is rotationally mounted within the fan housing, the fan being in operative communication with the PTO shaft of the vehicle; an auger disposed within the box and between the inner first surface and the fan housing along the longitudinal direction, the auger comprising a plurality of lift pallets disposed approximately at the center thereof, the auger being in operative communication with the PTO shaft of the vehicle; and a snow deflector comprising an inner second surface extending between the inner first surface of the box and the fan housing, the inner second surface inclined to the horizontal along a second direction that is other than perpendicular to the first direction, such that the inner second surface of the snow deflector and the inner first surface of the box cooperate to form a generally inverted V-shaped channel having a cross-sectional surface area that decreases continuously along a snow-guiding direction toward the fan, wherein an apex of the generally inverted V-shaped channel, which is formed between the inner second surface of the snow deflector and the inner first surface of the box, is aligned generally along a direction that is laterally toward a predetermined target region of the snow-receiving opening of the fan housing and that is after a discharge chute opening in the fan housing along a direction of rotation of the fan, and wherein during use snow is guided within the generally inverted V-shaped channel along the direction that is laterally toward the predetermined target region of the snow-receiving opening of the fan housing.

According to an aspect of at least one embodiment, there is provided a method for clearing snow from a ground surface, comprising: moving a snow blower across the ground surface that is to be cleared of snow, the snow blower having a box with an inner first surface for containing snow during the moving of the snow blower; using an auger that is mounted within the box, moving the contained snow laterally inward toward a central portion of the box; using lift pallets of the auger system, lifting the contained snow upwardly from the central portion and toward a deflector region of the snow blower; within the deflector region, guiding the lifted snow laterally toward a predetermined target region of a snow-receiving opening of a fan housing, and simultaneously guiding the lifted snow vertically upward and longitudinally frontward toward the predetermined target region of the snow-receiving opening; and using a fan disposed within the fan housing, transporting the guided snow from the predetermined target region to a discharge chute opening along a direction of rotation of the fan, wherein the predetermined target region of the snow-receiving opening of the fan housing is after the chute discharge opening along the direction of rotation of the fan, and wherein guiding the lifted snow comprises directing the lifted snow along a generally inverted V-shaped channel that is formed between a second surface portion of a snow deflector and the inner first surface of the box, the second surface portion of the snow deflector being fixedly secured to the inner first surface of the box, wherein the second surface portion of the snow deflector and the inner first surface of the box are disposed within first and second respective planes that intersect one another along an apex of the generally inverted V-shaped channel, said apex being aligned generally toward the predetermined target region of the snow-receiving opening.

BRIEF DESCRIPTION OF THE DRAWINGS

The instant invention will now be described by way of example only, and with reference to the attached drawings, wherein similar reference numerals denote similar elements throughout the several views, and in which.

It should be understood that the drawings are not necessarily to scale. In certain instances, details that are not necessary for an understanding of the disclosure or that render other details difficult to perceive have been omitted. By way of an example, hydraulic cylinders, lines and pumps are not shown in the various views. Additionally, flanges and/or tabs carried by certain components are not illustrated in all of the views, although they are understood to be present when needed for the purpose of securing said components to other surfaces of the snow blower.

DETAILED DESCRIPTION OF EMBODIMENTS OF THE INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed, but is to be accorded the widest scope consistent with the principles and features disclosed herein.

Figure 1:
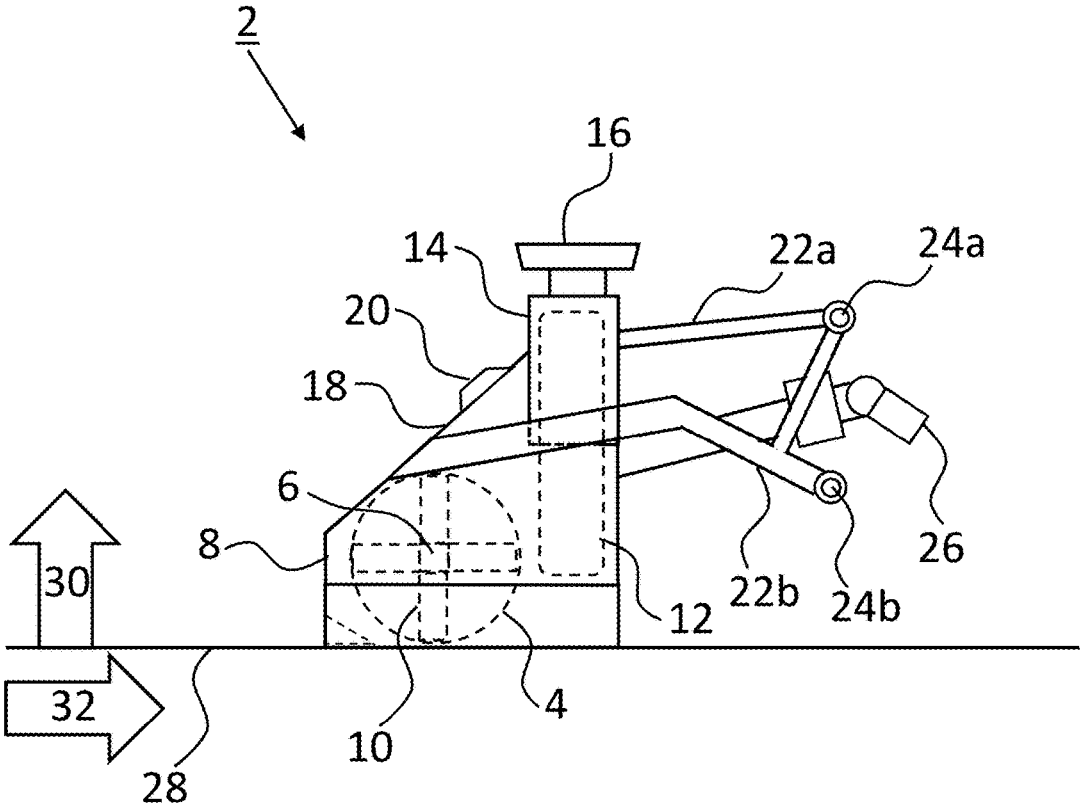
FIG. 1 is a simplified side view of a pull-type snow blower.

FIG. 1 is a simplified side view of a pull-type snow blower 2. The snow blower 2 includes an auger having a helical screw blade 4 mounted on a laterally extending axle 6, which is disposed within a box 8 forming a part of a frame of the snow blower 2. A plurality of lift pallets 10 is mounted to the axle 6 at an approximately central portion thereof. The lift pallets 10 lift the snow from the ground surface, and direct the lifted snow vertically upward and longitudinally frontward toward the fan 12, which is disposed within a fan housing 14. A discharge chute mount 16 is shown in communication with a not illustrated discharge chute opening in the peripheral wall of the fan housing 14. A discharge chute (not shown in FIG. 1) is fixedly secured to the discharge chute mount 16 when the snow blower 2 is in a fully assembled condition. In the specific example that is shown in FIG. 1 there is a removable fan access door 18 disposed for covering a fan access port in the rear wall of box 8. A pair of handles 20 or another suitable grasping means is provided on the fan access door 18 for facilitating the removal and replacement of the fan access door 18, such as for instance during servicing of the fan.

The snow blower 2 further includes a hitch assembly comprising a plurality of attachment arms 22, in particular three attachment arms 22 consisting of an upper attachment arm 22*a* with an upper link pin 24*a*, and two lower attachment arms 22*b* each with a respective lower link pin 24*b* (only one lower attachment arm 22*b* and one lower link pin 24*b* is visible in FIG. 1). The hitch assembly may be used to couple the snow blower 2 to the three-point hitch of a tractor in conventional fashion. Additionally, snow blower 2 includes an implement input driveline (IID) or driveshaft 26 for being rotatably coupled with a power take off (PTO) shaft of the tractor. Power is provided from the tractor to the snow blower 2 for turning the fan and the auger, etc. In practice, the driveshaft 26 may include a plurality of driveshafts that are interconnected via not illustrated gears and/or other mechanical and/or fluid linkages.

Referring still to FIG. 1, the snow blower 2 is illustrated on a surface 28. Surface 28 is for instance a ground surface. More particularly, surface 28 is a ground surface or another surface that is to be cleared of snow. Throughout the description and in the claims, terms such as "upward" are to be understood as being generally in the direction of the block arrow 30 shown in FIG. 1, relative to a substantially horizontal surface. Additionally, terms such as "frontward," and "forward," etc. are to be understood as being generally in the direction of the block arrow 32 shown in FIG. 1. For instance, the upper and lower attachment pins 24*a* and 24*b* are considered to be located at the "front" of the snow blower 2 and the fan access door 18 is considered to be located at the "back" or "rear" of the snow blower 2. During use, the snow blower 2 is pulled "forward" over the surface 28 that is to be cleared of snow, thereby clearing snow along a path that is "behind" a not illustrated tractor or another similar vehicle to which the snow blower 2 is attached.

Figure 2:
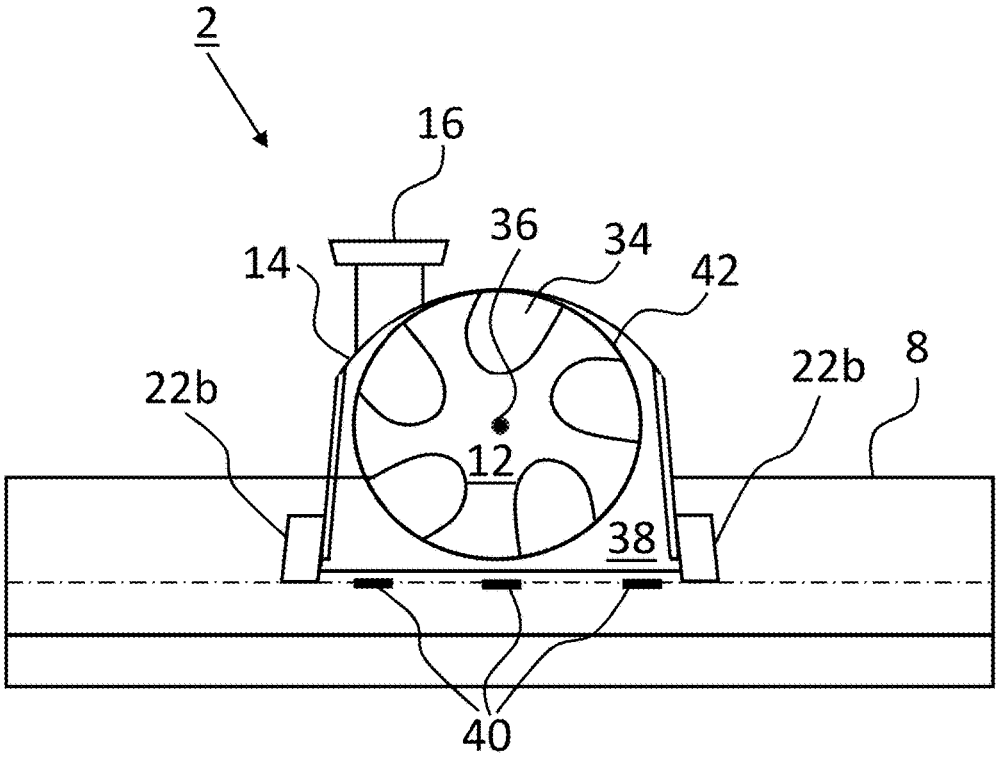
FIG. 2 is a simplified rear view of a pull-type snow blower, with a fan access door removed.

Referring now to FIG. 2, shown is a simplified rear view of a pull-type snow blower 2. The fan 12 includes a plurality of radially extending blades or vanes 34, and in the specific example shown in FIG. 2 there are five blades or vanes 34. The fan 12 includes a longitudinally extending shaft or axle 36, about which the fan 12 rotates during use. The shaft or axle 36 is in operative communication with the IID 26, via which power is transferred from the PTO shaft of the tractor. In FIG. 2 the fan access door 18 is in a removed condition, such that the fan 12 is visible through the fan access port 38. Slots 40 are provided in the box 8 for receiving complementary tabs that are carried by the fan access door 18. Alternatively, another system is provided for aligning and securing the fan access door 18 to the back of the snow blower 2. FIG. 2 also illustrates a snow-receiving opening 42 in the fan housing 14. During use, snow that is lifted by the lift pallets 10 is directed toward the fan 12 through the snow-receiving opening 42.

Figure 3:
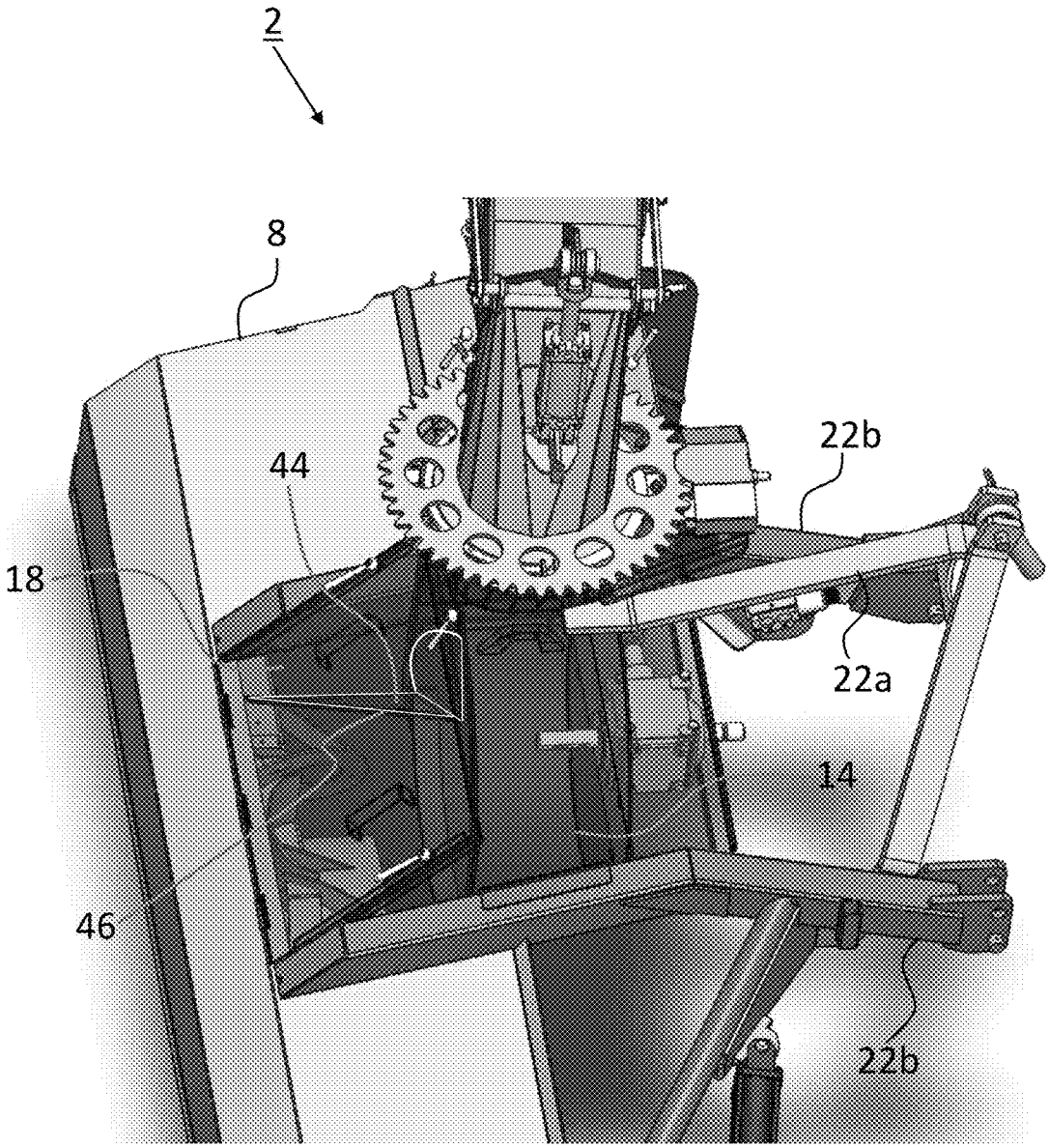
FIG. 3 is a simplified partial top perspective view of a pull-type snow blower, which is equipped with a snow deflector according to an embodiment.

FIG. 3 is a simplified partial top perspective view of the snow blower 2, showing a snow deflector 44 according to an embodiment. The fan access door 18 and the fan housing 14 are partially transparent in FIG. 3, in order to better illustrate the internal features of the snow blower 2. As is discussed in greater detail in the following paragraphs, the snow deflector 44 is fixedly secured to an inner first surface of the snow blower box 8, which in the example that is shown in FIG. 3 is the inside surface of fan access door 18. In particular, snow deflector 44 and fan access door 18 abut one another along line 46 in FIG. 3. Line 46 is also referred to throughout the description and in the claims as the "apex" of an inverted generally V-shaped channel that is formed between the adjacent surfaces of the snow deflector 44 and the fan-access door 18.

Figure 4:
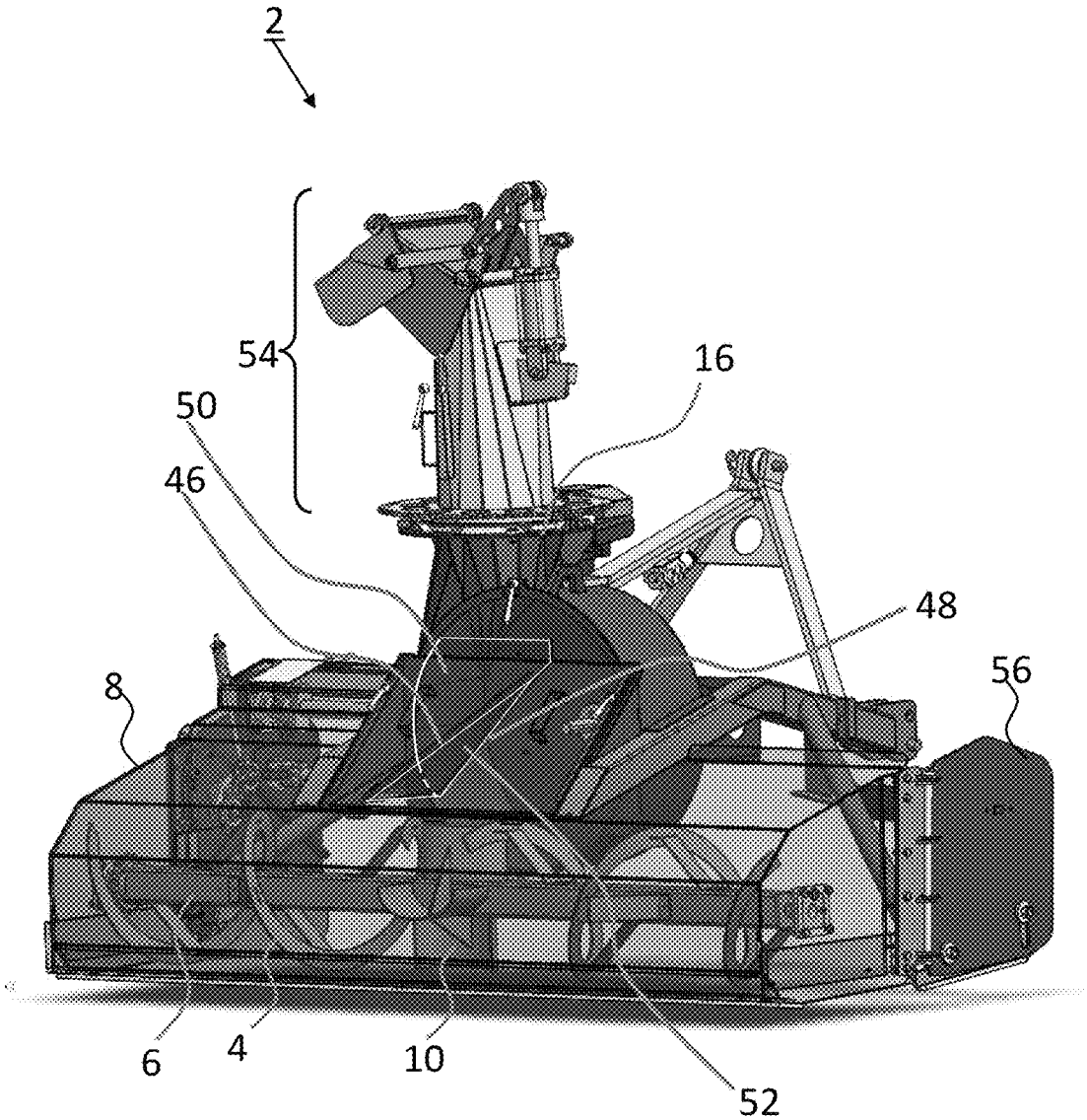
FIG. 4 is a simplified rear perspective view of a pull-type snow blower, which is equipped with a snow deflector according to an embodiment.

FIG. 4 is a simplified rear perspective view of the snow blower 2, showing a snow deflector 44 according to an embodiment. FIG. 4 also illustrates a discharge chute 54 attached to the discharge chute mount 16, as well as adjustable wings 56 that can be operated in order to vary the width of the path that is cleared of snow during a single pass. The fan access door 18 and the box 8 are partially transparent in FIG. 4, in order to better illustrate the internal features of the snow blower 2. The snow deflector 44 includes two contiguous surface portions, which share a common edge along fold line 48. More particularly, a first surface portion 50 is disposed parallel to the snow-receiving opening 42 of the fan housing 14. The first surface portion 50 covers a portion of the snow-receiving opening 42 that is proximate the discharge chute opening in the fan housing 14. A second surface portion 52 extends away from the fold line 48 to the edge 46 that is fixedly secured to the inside surface of the fan access door 18, as discussed supra.

Figure 8:
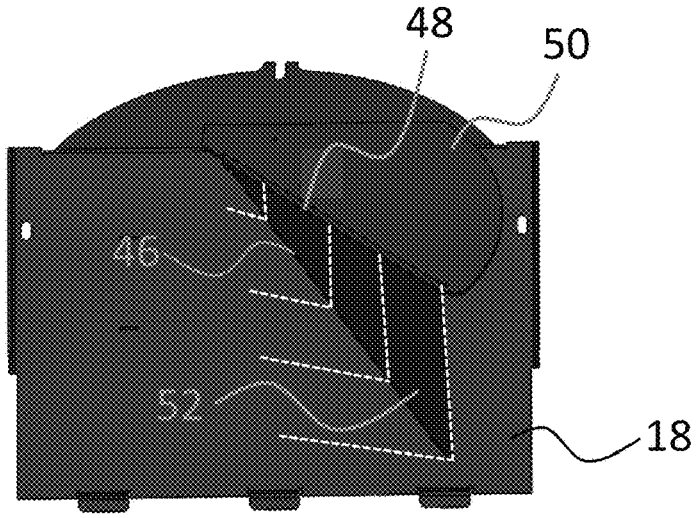
FIG. 8 is a simplified view of the interior features of the fan-access door that is shown in FIG. 7.
Figure 9:
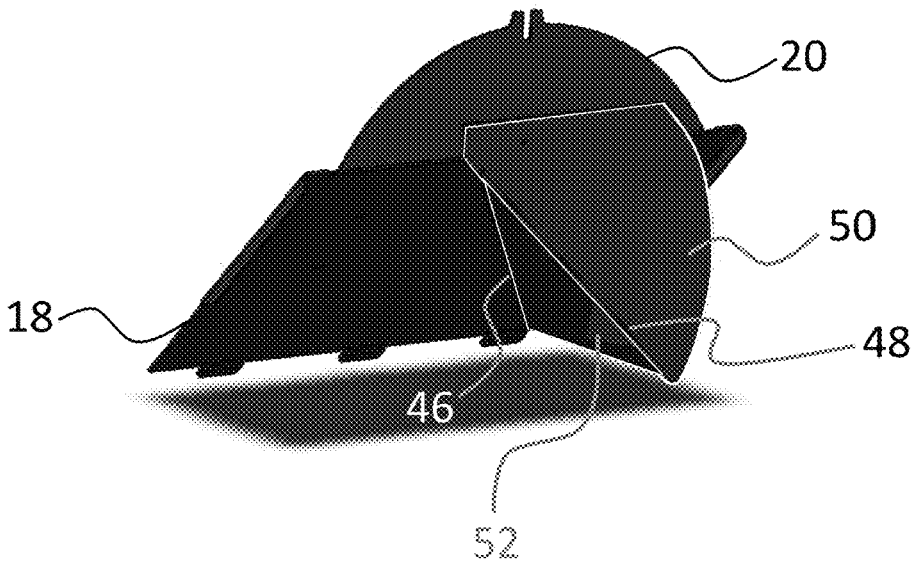
FIG. 9 is a simplified perspective view of the interior features of the fan-access door that is shown in FIG. 7.
Figure 10:
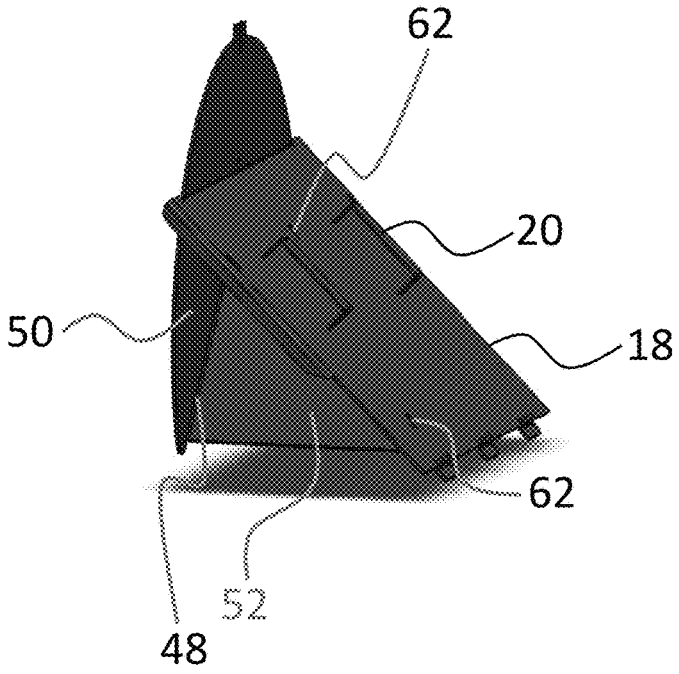
FIG. 10 is a simplified side perspective view of the fan-access door that is shown in FIG. 7.

FIGS. 8-10 show several additional views of the snow deflector 44 fixedly secured to the inside surface of the fan access door 18. As is apparent, the first surface portion 50 is contained within a first plane 64 and the second surface portion 52 is contained within a second plane 66. The planes 64 and 66 intersect one another at a non-right angle, along line 48. In particular, the planes 64 and 66 intersect one another at an angle that is greater than 90°.

The second surface portion 52 is generally triangular in shape, and cooperates with the inside surface of the fan access door 18 to form the inverted generally V-shaped channel, as is shown using dashed lines in FIG. 8.

Figure 7:
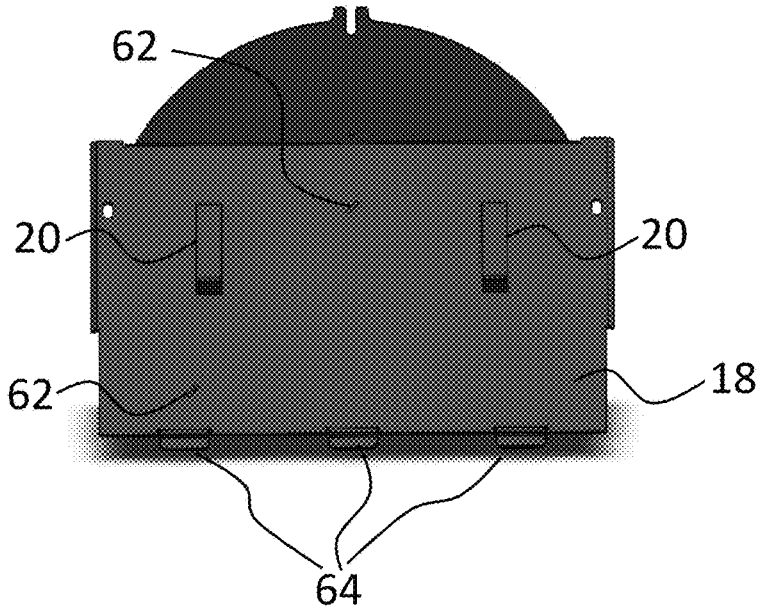
FIG. 7 is a simplified view of the exterior features of a fan-access door for a pull-type snow blower, which is equipped with a snow deflector according to an embodiment.

Referring now to FIG. 7, the fan access door 18 includes slots 62 for receiving complementary tabs that are carried along the edge 46 of snow deflector 44. Alternatively, another system provided for securing the snow deflector to the fan access door 18. The snow deflector 44 may additionally or alternatively be welded, bolted, or riveted to the fan access door 18. FIG. 7 further illustrates the plurality of tabs 64 disposed along the lower edge of the fan access door 18, each of the tabs 64 for being inserted into one of the slots 40 in box 8 of the snow blower 2.

When the fan access door 18 is in an installed condition, the inverted generally V-shaped channel has a cross-sectional surface area that decreases continuously along a snow-guiding direction, which is vertically upward, laterally rightward (as viewed from the rear of snow blower 2) and longitudinally frontward. During use, the helical screw blade 4 of the auger transports the snow laterally toward the center of box 8, where it is lifted by the lift pallets 10 and fed into the inverted generally V-shaped channel that is formed between the inside surface of the fan access door 18 and second surface portion 52 of the snow deflector 44. The continuous operation of the auger causes the snow to move along the snow-guiding direction within the inverted generally V-shaped channel, toward the snow-receiving opening 42 of the fan housing 14. As the snow progresses through the channel, the volume per unit length decreases and as a result the snow becomes compacted. Further, the inverted generally V-shaped channel is configured to guide the snow to a predetermined target region of the snow-receiving opening 42.

Figure 6:
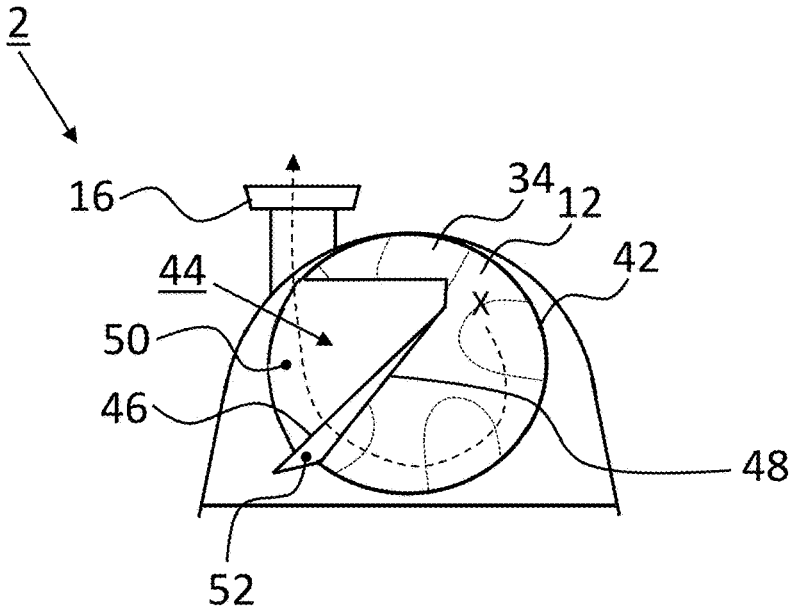
FIG. 6 is a simplified partial rear view of a pull-type snow blower, showing a fan portion equipped with a snow deflector according to an embodiment.

Referring also to FIG. 6, shown is a simplified partial rear view of the snow blower 2, showing the snow deflector 44. It is to be understood that the snow deflector 44 is fixedly secured to fan access door 18 along edge 46, but that in order to provide improved clarity the fan access door 18 is not shown in FIG. 6. The predetermined target region, which is indicated by the X in FIG. 6, is located approximately in line with the apex (line 46) of the inverted generally V-shaped channel. Snow that is introduced into the fan 12 at the predetermined target region X follows the dashed-line path shown in FIG. 6, as the fan 12 rotates in a clockwise direction. The predetermined target region is located after the discharge chute opening in the fan housing 14 along the direction of rotation of the fan 12. Advantageously, snow that is introduced at the predetermined target region X does not interfere with the snow that is being discharged via the discharge chute opening. Further, the predetermined target region X is selected to ensure that the snow experiences a relatively long travel path within the fan 12 prior to being discharged via the discharge chute opening. Advantageously, the snow becomes packed as it is being transported within the fan 12, and by providing a relatively long travel path the degree of snow compaction can be maximized prior to discharging the snow via the discharge chute opening.

Figure 5:
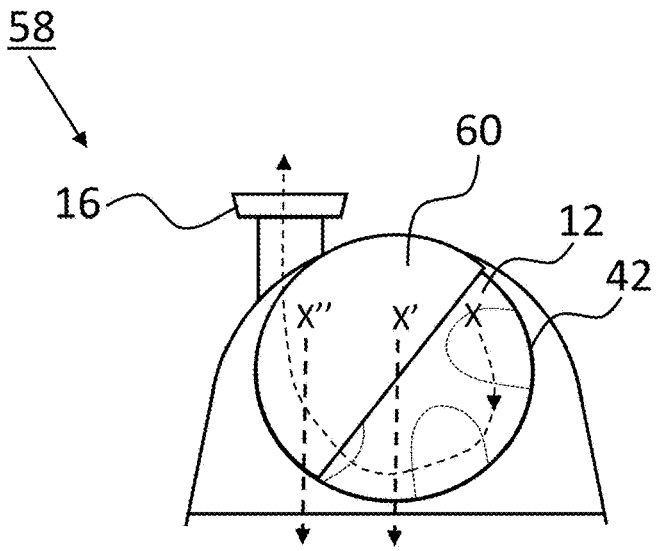
Fig. 5 (Prior Art)
FIG. 5 is a simplified partial rear view of a pull-type snow blower, showing a fan housing equipped with a blocker plate according to the prior art.

Referring now to FIG. 5, shown is a simplified partial rear view of another snow blower 58, which is equipped with a blocker plate 60 according to the prior art. Notably, the snow blower 58 does not include an element for guiding/deflecting snow, and as such the not illustrated lift pallets merely throw the snow indiscriminately toward the snow-receiving opening 42. Some of the snow is received at region X in FIG. 5, which corresponds substantially to the predetermined target region X that was discussed supra with reference to FIG. 6. The snow that is received at region X follows a relatively long a path through the fan 12 and is discharged out through the discharge chute opening. On the other hand, snow that is directed at the region X' collides with the blocker plate 60 and does not pass through the snow-receiving opening 42 into the fan 12, but rather it falls back to the ground surface along the vertical dashed-line path and must be picked up by the lift pallets a second time. Blocking the snow from being introduced into the fan 12 at the region X' prevents the snow from being mixed into the air flow within the central portion of the fan 12, which can result in the formation of a light mist of snow that may accumulate on the cleared ground surface. Snow that is directed at the region X" also collides with the blocker plate 60 and does not pass through the snow-receiving opening 42 into the fan 12, but rather it also falls back to the ground surface along the vertical dashed-line path and must be picked up by the lift pallets a second time. Blocking the snow from being introduced into the fan 12 at the region X" prevents the snow from interfering with other snow that was introduced at the region X, and which has travelled around the fan 12 to the discharge chute opening.

The prior art solution that is illustrated in FIG. 5 has a number of disadvantages associated therewith. Firstly, only a portion of the snow that is picked up by the lift pallets is introduced into the fan 12 at region X. The remainder of the snow falls back to the ground and must be "recycled" to the fan 12. The prior art solution is therefore inefficient since the snow must be lifted multiple times before entering the fan 12. Additionally, the prior art solution is inefficient because any snow colliding with the blocker plate 60 at the end of each pass simply drops back to the ground, leaving an undesired pile of snow in the middle of the road. The snow plow operator must then make a final pass to clear the snow piles from the road, which wastes both time and fuel. Secondly, the prior art solution compacts the snow only while the snow is being transported within the fan toward the discharge chute opening. The snow that emerges from the top of the discharge chute is loosely packed, and typically spreads out with increasing distance from the top of the discharge chute to become distributed over a relatively large ground area.

In contradistinction, the snow deflector 44 does not block any of the snow from entering into the fan 12, but rather it guides substantially all of the snow toward the predetermined target region "X" within the snow-receiving opening 42. Advantageously, substantially all of the snow that is lifted by the lift pallets is introduced into the fan 12 the first time it is cycled through, thereby improving operating efficiency relative to the prior art solution discussed supra. Further, since all of the snow is directed to the predetermined target region X, the problems of snow reaccumulation on the ground surface and interference with snow being discharged via the discharge chute opening are overcome. Further still, undesired piles of snow are not formed at the end of each pass, thereby eliminating the need to make one final pass to clear accumulated snow piles from the road. In addition, as discussed supra the snow deflector 44 cooperates with the inside surface of the fan access door 18 to form an inverted generally V-shaped channel for guiding the snow toward the predetermined target region. Since the cross-sectional surface area of the inverted generally V-shaped channel decreases continuously along the snow guiding direction (i.e., vertically upward, laterally rightward and longitudinally frontward), the snow becomes compacted in multiple directions prior to being introduced into the fan 12. Further, since the predetermined target region is selected to maximize the snow travel path within the fan 12, the snow becomes significantly more compacted as it is being transported to the discharge chute opening. This enhanced compaction relative to the prior art advantageously improves the accuracy with which the snow may be deposited within a desired discharge area, and reduces the reaccumulation of snow onto the just cleared ground surface and surrounding buildings and/or vehicles. In addition, the processing speed of the snow through the discharge chute opening is increased, the snow may be thrown a greater distance, less snow-mist is produced and thereby the deposition of a light covering of snow is reduced, and left snow is left in piles in the street at the end of each pass.

Figure 11:
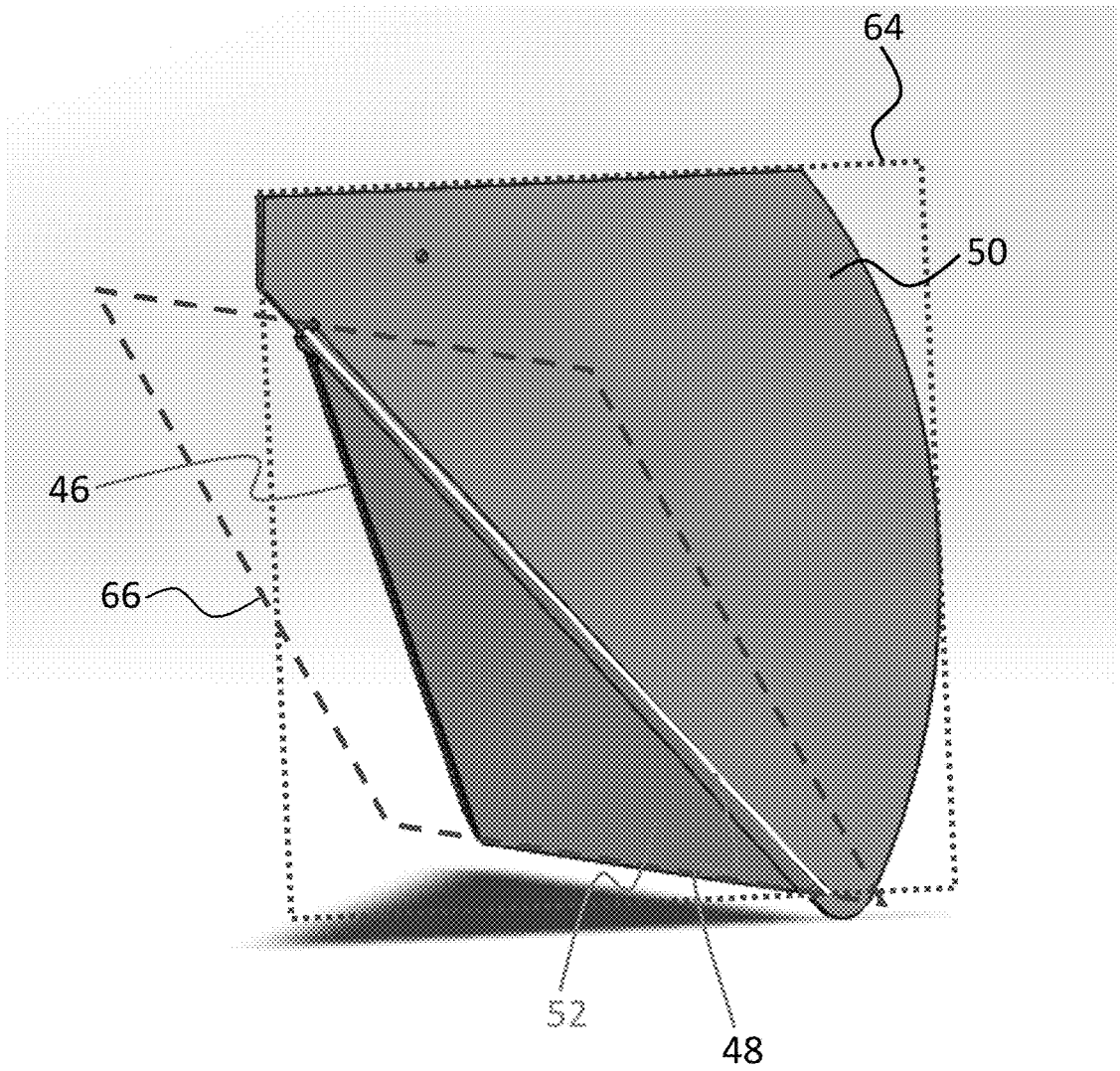
FIG. 11 is a simplified perspective view of a snow deflector according to an embodiment, showing the first and second surface portions contained within respective first and second intersecting planes.
Figure 12:
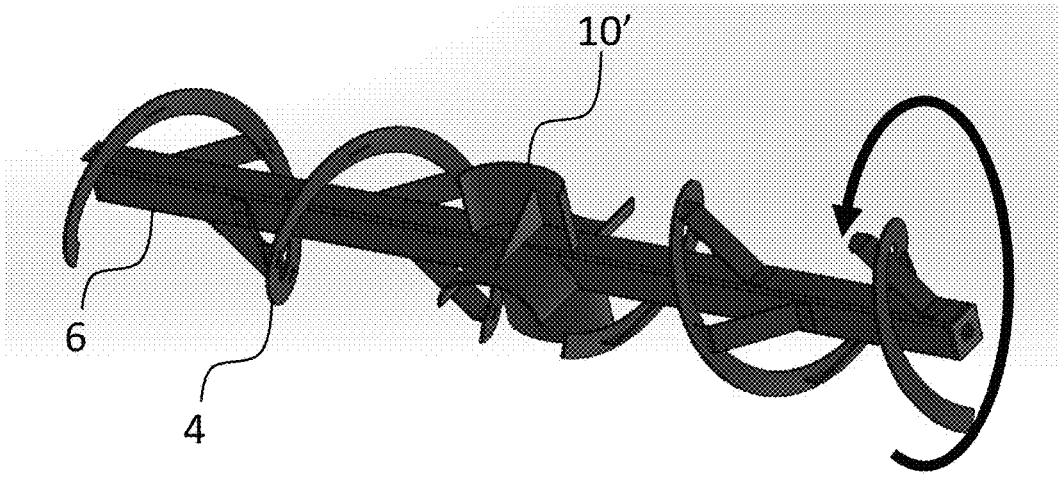
FIG. 12 is a simplified perspective view of an auger assembly including curved lift-pallets, according to an embodiment.
Figure 13:
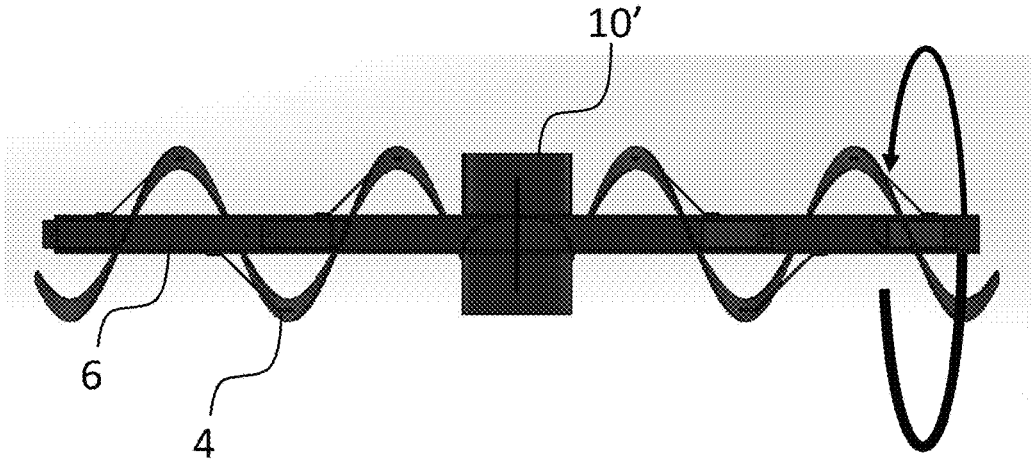
FIG. 13 is a simplified front view of the auger assembly shown in FIG. 12.

Optionally, lift pallets having a snow lifting surface that is curved concavely in the direction of rotation of the auger axle may be used to enhance snow compaction even further. FIGS. 11 and 12 are perspective and front views, respectively, of an auger with curved lift pallets 10'. The curved lift pallets 10' contain the snow laterally, and also begin to compact the snow as it is being lifted toward the fan. In contradistinction, flat lift pallets (found in prior art snow blowers) tend to beat and stir up the snow in an inefficient manner.

Optionally, the snow blower 2 does not include a removable fan access door 18, in which case the snow deflector 44 is secured directly to an inner first surface of the box 8.

Further optionally, the discharge chute 54 is tapered toward the discharge end (i.e., the upper end). In particular, both the width and the depth of the discharge chute decrease along the length thereof. The tapered shape of the discharge chute serves to further compact the snow before it is finally discharged from the discharge end.

In an alternative embodiment, a snow deflector for a pull-type snow blower comprises a triangular plate member that is dimensioned similarly to the second surface portion 52. In this embodiment, the triangular plate member is fixedly secured to the inside surface of fan access door 18. The fan housing 14 is modified such as for instance by providing a non-circular snow-receiving opening. By way of a specific and non-limiting example, the snow-receiving opening is formed such that the function of the first surface portion 50 of snow deflector 44 is integrated into the fan housing 14. An edge of the triangular plate member, which corresponds to the shared edge 48 of the snow deflector 44, abuts the fan housing. Optionally, the fan housing carries guides for receiving the edge of the triangular plate member, such that it is aligned properly with the fan housing. Alternatively, the fan housing has a generally circular snow-receiving opening and a separate plate member, which is dimensioned similarly to the first surface portion 50 of snow deflector 44, is secured to the fan housing so as to cover a portion of the snow-receiving opening that is proximate the discharge chute opening in the fan housing. The separate plate member optionally is permanently secured to the fan housing (such as by welding or riveting), or is irremovably secured to the fan housing (such as by bolting or using a tab-and-slot system).

While the above description constitutes a plurality of embodiments of the present invention, it will be appreciated that the present invention is susceptible to further modification and change without departing from the fair meaning of the accompanying claims.

What is claimed is:

1. A snow deflector for a snow blower, comprising:

a plate member having a first surface portion configured for being disposed covering a portion of a snow-receiving opening of a fan housing of the snow blower when the plate member is in an installed condition, and having a second surface portion configured to cooperate with an adjacent rear interior surface of the snow blower to guide snow, which is lifted toward the plate member using lift pallets mounted on an auger axle, along a direction that is laterally toward a predetermined target region of the snow-receiving opening of the fan housing and that is after a discharge chute opening in the fan housing along a direction of rotation of a fan that is disposed within the fan housing, and for simultaneously guiding the snow vertically upward and longitudinally frontward toward the predetermined target region of the snow-receiving opening, wherein the first and second surface portions of the plate member are disposed within respective first and second planes that intersect one another along a common edge that is shared between the first and second surface portions, and wherein said common edge is aligned generally toward the predetermined target region of the snow-receiving opening of the fan housing when the plate member is in the installed condition.

2. A snow deflector according to claim 1, wherein the second surface portion of the plate member is generally triangular in shape.

3. A snow deflector according to claim 1, wherein the first and second planes intersect one another at an angle that is greater than 90°.

4. A snow deflector according to claim 1, wherein the first surface portion of the plate member has a curved edge portion adapted to substantially follow a curved portion of the snow-receiving opening of the fan housing proximate the discharge chute opening.

5. A snow blower for being mounted to a vehicle and for being powered by a power take off (PTO) shaft of said vehicle, comprising:

a box for containing snow to be removed from a ground surface, the box having an inner first surface that is inclined to the horizontal along a first direction;

a fan housing disposed longitudinally frontward of the inner first surface along a snow clearing direction, the fan housing having a snow-receiving opening facing the inner first surface of the box and having a discharge chute opening;

a fan disposed within the fan housing and comprising a plurality of radially extending blades that is rotationally mounted within the fan housing, the fan being in operative communication with the PTO shaft of the vehicle;

an auger disposed within the box and between the inner first surface of the box and the fan housing along the longitudinal direction, the auger comprising a plurality of lift pallets disposed approximately at the center thereof, and the auger being in operative communication with the PTO shaft of the vehicle; and a snow deflector, comprising:

a plate member having a first surface portion disposed parallel to the snow-receiving opening of the fan housing of the snow blower, and having a second surface portion fixedly secured to the inner first surface of the box and being configured to cooperate with said interior first surface of the box to guide snow, which is lifted toward the plate member using the lift pallets mounted on the auger, along a direction that is laterally toward a predetermined target region of the snow-receiving opening of the fan housing and that is after the discharge chute opening in the fan housing along a direction of rotation of the fan, and for simultaneously guiding the snow vertically upward and longitudinally frontward toward the predetermined target region of the snow-receiving opening, wherein the first and second surface portions of the plate member are disposed within respective first and second planes that intersect one another along a common edge shared between the first and second surface portions, and wherein said common edge is aligned generally toward the predetermined target region of the snow-receiving opening of the fan housing.

6. A snow blower according to claim 5, wherein the second surface portion of the plate member is generally triangular in shape.

7. A snow blower according to claim 5, wherein the first and second planes intersect one another at an angle that is greater than 90°.

8. A snow blower according to claim 5, wherein the first surface portion of the plate member has a curved edge portion adapted to substantially follow a curved portion of the snow-receiving opening of the fan housing proximate the discharge chute opening.

9. A snow blower according to claim 5, comprising a plurality of posts extending longitudinally frontward from the box for connecting the snow blower to a three-point hitch of a tractor, wherein the snow blower is a pull-type snow blower for being mounted behind a tractor via said three-point hitch thereof.

10. A snow blower according to claim 5, wherein the lift pallets have a concavely curved snow-contacting surface along a direction of rotation of the auger.

11. A snow blower according to claim 5, comprising a removable fan-access door forming at least a portion of the inner first surface of the box.

12. A snow blower according to claim 11, wherein the snow deflector is mounted to the fan-access door and is removable with the fan-access door as a single component.

13. A snow blower according to claim 5, wherein the second surface portion of the plate member and the inner first surface of the box cooperate to form a generally inverted V-shaped channel having a cross-sectional surface area that decreases continuously along a snow-guiding direction toward the fan.

14. A snow blower according to claim 13, wherein an apex of the generally inverted V-shaped channel, which is formed between the second surface portion of the plate member and the inner first surface of the box, is aligned generally toward the predetermined target region of the snow-receiving opening of the fan housing.

15. A snow blower according to claim 5, wherein the predetermined target region of the snow-receiving opening is a generally pie-shaped region of the snow-receiving opening that is swept out by less than one-quarter of a full rotation of the fan.

16. A snow blower according to claim 15, wherein the snow-receiving opening is generally circular in shape, and the highest point along the snow-receiving opening relative to the horizontal surface is defined to be 0° rotation, and wherein the pie-shaped region extends between about 30° rotation and about 90° rotation, and wherein the chute discharge opening is disposed between about 270° rotation and 0° rotation.

17. A snow blower for being mounted to a vehicle and for being powered by a power take off (PTO) shaft of said vehicle, comprising:

a box for containing snow to be removed from a ground surface, the box having an inner first surface that is inclined to the horizontal along a first direction;

a fan housing disposed longitudinally frontward of the inner first surface along a snow clearing direction, the fan housing having a snow-receiving opening facing the inner first surface of the box;

a fan disposed within the fan housing and comprising a plurality of radially extending blades that is rotationally mounted within the fan housing, the fan being in operative communication with the PTO shaft of the vehicle;

an auger disposed within the box and between the inner first surface and the fan housing along the longitudinal direction, the auger comprising a plurality of lift pallets disposed approximately at the center thereof, the auger being in operative communication with the PTO shaft of the vehicle; and a snow deflector comprising an inner second surface extending between the inner first surface of the box and the fan housing, the inner second surface inclined to the horizontal along a second direction that is other than perpendicular to the first direction, such that the inner second surface of the snow deflector and the inner first surface of the box cooperate to form a generally inverted V-shaped channel having a cross-sectional surface area that decreases continuously along a snow-guiding direction toward the fan, wherein an apex of the generally inverted V-shaped channel, which is formed between the inner second surface of the snow deflector and the inner first surface of the box, is aligned generally along a direction that is laterally toward a predetermined target region of the snow-receiving opening of the fan housing and that is after a discharge chute opening in the fan housing along a direction of rotation of the fan, and wherein during use snow is guided within the generally inverted V-shaped channel along the direction that is laterally toward the predetermined target region of the snow-receiving opening of the fan housing.

18. A snow blower according to claim 17, wherein the snow is guided simultaneously within the generally inverted V-shaped channel both vertically upward and longitudinally frontward toward the predetermined target region of the snow-receiving opening.

19. A snow blower according to claim 17, wherein the inner second surface is generally triangular in shape.

20. A snow blower according to claim 17, wherein the lift pallets have a concavely curved snow-contacting surface along a direction of rotation of the auger.

21. A method for clearing snow from a ground surface, comprising:

moving a snow blower across the ground surface that is to be cleared of snow, the snow blower having a box with an inner first surface for containing snow during the moving of the snow blower;

using an auger that is mounted within the box, moving the contained snow laterally inward toward a central portion of the box;

using lift pallets of the auger system, lifting the contained snow upwardly from the central portion and toward a deflector region of the snow blower;

within the deflector region, guiding the lifted snow laterally toward a predetermined target region of a snow-receiving opening of a fan housing, and simultaneously guiding the lifted snow vertically upward and longitudinally frontward toward the predetermined target region of the snow-receiving opening; and using a fan disposed within the fan housing, transporting the guided snow from the predetermined target region to a discharge chute opening along a direction of rotation of the fan, wherein the predetermined target region of the snow-receiving opening of the fan housing is after the chute discharge opening along the direction of rotation of the fan, and wherein guiding the lifted snow comprises directing the lifted snow along a generally inverted V-shaped channel that is formed between a second surface portion of a snow deflector and the inner first surface of the box, the second surface portion of the snow deflector being fixedly secured to the inner first surface of the box, wherein the second surface portion of the snow deflector and the inner first surface of the box are disposed within first and second respective planes that intersect one another along an apex of the generally inverted V-shaped channel, said apex being aligned generally toward the predetermined target region of the snow-receiving opening.

* * * * *